United States Patent [19]

Day

[11] Patent Number: 4,720,259

[45] Date of Patent: Jan. 19, 1988

[54] HAND TORCH

[76] Inventor: Jerry J. Day, 134 Forge Road S.E., Calgary, Alberta, Canada, T2H 0S8

[21] Appl. No.: 48,283

[22] Filed: May 11, 1987

[51] Int. Cl.[4] ..... F23Q 7/12

[52] U.S. Cl. ..... 431/255; 431/285; 431/344; 431/345

[58] Field of Search ..... 431/255, 285, 344, 345

[56] References Cited

U.S. PATENT DOCUMENTS

| | | | |
|---|---|---|---|
| 1,938,851 | 12/1933 | McKee | 431/285 |
| 2,666,480 | 1/1954 | Peterson | 431/255 |
| 3,802,828 | 4/1974 | Mercer et al. | 431/255 |

*Primary Examiner*—Carroll B. Dority, Jr.

*Attorney, Agent, or Firm*—George H. Dunsmuir

[57] ABSTRACT

A simple, streamlined portable hand torch for attachment to a small propane or regulated natural gas tank includes an elongated barrel containing a venturi passage extending between the ends of the barrel, and a recess normally closed by a removable cover containing a retention gas line, a handle attached to one end of the barrel for receiving the top end of a propane tank; or quick disconnect for natural gas the handle containing an inlet passage for feeding gas to inlet ends of the retention gas line and the venturi passage; an elongated burner tube connected to the outlet end of the venturi passage; a burner nozzle on the outer free end of the burner tube; a retention line for carrying propane or natural gas from the retention line in the recess to the perforated outer free end of the burner nozzle; a spark plug extending into the venturi passage for igniting the propane/natural gas and air introduced through an opening in the bottom of the barrel; a piezoelectric arc crystal for firing the spark plug, and a push button mounted in a recess in the side of the barrel for actuating the arc crystal. The gas initially flows through both a restricted orifice in the retention line and a restricted orifice into the venturi passage. The gas and air mixture in the venturi passage is ignited by the spark plug and the flame travels to the burner nozzle to ignite the propane/natural gas discharged from the gas retention line. Once burning has been initiated at the burner nozzle, air is sucked into the venturi passage mixed with gas and flows through the burner tube to the burner nozzle for ignition by burning gas from the retention line.

7 Claims, 5 Drawing Figures

HAND TORCH

BACKGROUND OF THE INVENTION

This invention relates to a portable torch, and in particular to a portable hand torch for use with for example disposable propane containers, or quick disconnects hooked up to a natural gas supply.

A review of the patent literature reveals that portable torches for attachment to gas tanks or containers are by no means new. Examples of such torches are found in U.S. Pat. Nos. 3,220,459, which issued to E. D. Wilson on Nov. 30, 1965; 3,280,881, which issued to F. Hach Jr. et al on Oct. 25, 1966; 3,574,506, which issued to J. K. Locke on April 13, 1971 and 4,348,172, which issued to H. C. Miller on Sept. 7, 1982. In general, the prior art devices are found to be somewhat complicated in terms of structure and/or operation. Moreover, with some devices there exists the danger of so-called blowback in which burning of the propane occurs in the body of the torch.

The object of the present invention is to overcome the above identified problems by providing a relatively simple portable torch, which following ignition ensures that burning occurs only at the discharge or burner nozzle end of the torch.

Accordingly, the invention relates to a portable hand torch for attachment to a gaseous fuel source comprising elongated barrel means; handle means on one end of said barrel means; inlet passage means in said handle means for feeding gas from a gaseous fuel source to said barrel means; coupler means in said handle means for connecting a gaseous fuel tank to said inlet passage means; elongated burner tube means on the other end of said barrel means for receiving gas from the gaseouse fuel tank; burner nozzle means on an outer free end of said burner tube means for burning fuel; retention gas line means in said barrel means for carrying fuel from the inlet passage means to said burner nozzle means; venturi passage means in said barrel means for carrying fuel from said inlet passage means to the inlet end of said burner tube means; restricted orifice means in said venturi passage means for limiting the quantity of fuel entering the venturi passage means from said inlet passage means; inlet opening means in said venturi passage means for introducing air into said venturi passage means for mixing with the fuel entering said venturi passage means through said restricted orifice means; spark producing means in said venturi passage means for igniting the mixture of air and fuel in said venturi passage means, whereby, when fuel is fed into said inlet passage means under pressure, the fuel flows through the retention gas line means and said venturi passage means, and once ignition has been achieved in said venturi passage means flame passes through said burner tube means to ignite fuel from said retention gas line means, and thereafter burning is limited to the area of the burner nozzle means.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENTS

Figures 1, 2:
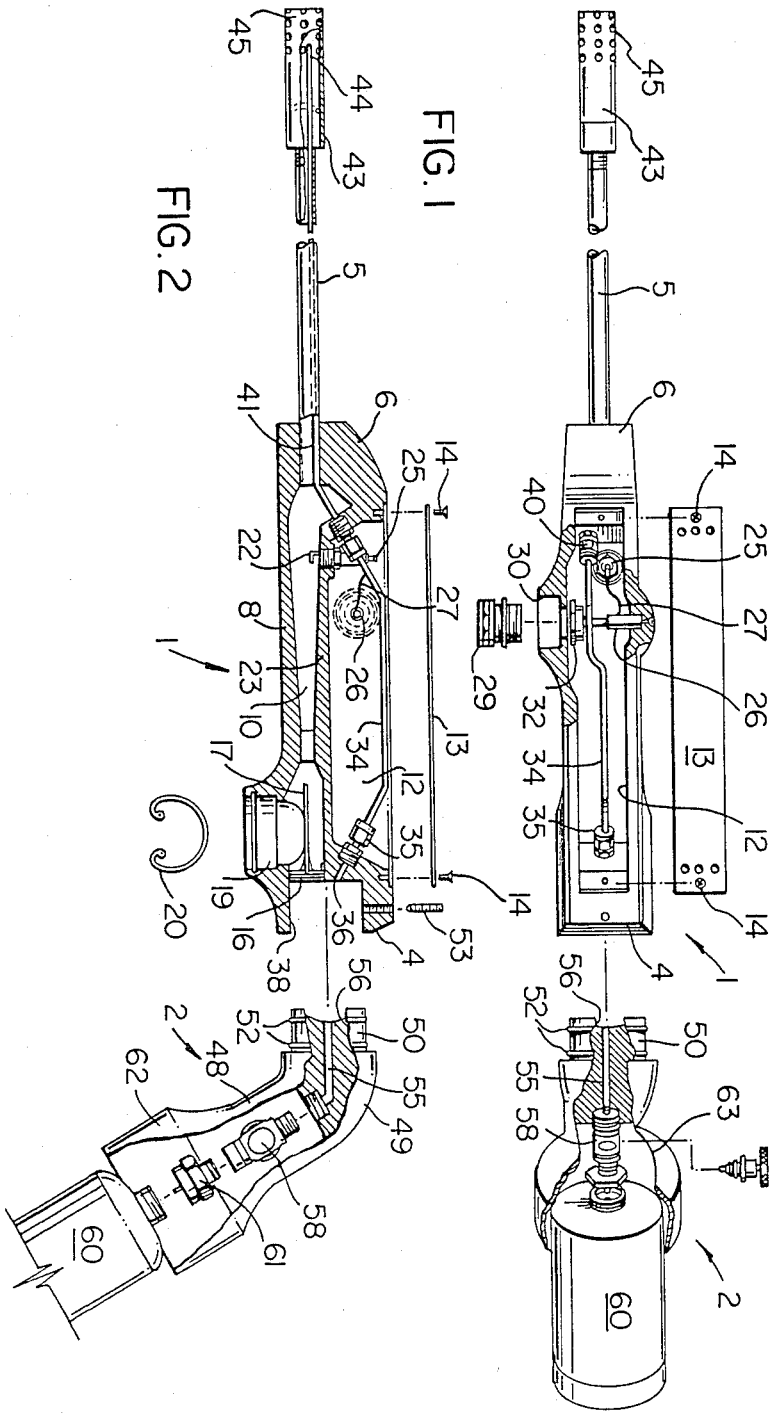
FIG. 1 is a partly sectioned plan view of a portable hand torch in accordance with the present invention.
FIG. 2 is a longitudinal sectional view of the torch of FIG. 1.
Figure 4:
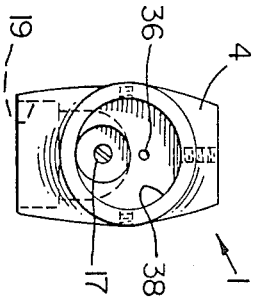
FIG. 4 is an end view of the barrel of FIG. 3, as seen from the right of FIG. 3.
Figure 3:
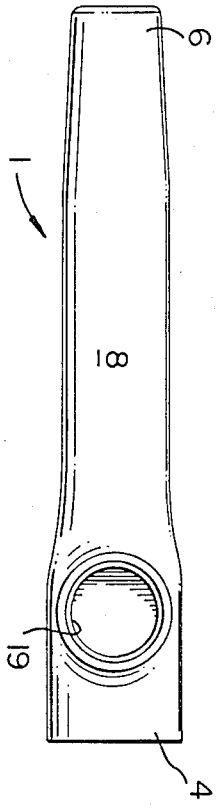
FIG. 3 is a bottom view of a barrel used in the torch of FIGS. 1 and 2.

With reference to FIGS. 1 and 2 of the drawings, the basic components of the torch of the present invention include an elongated barrel generaly indicated at 1, a handle generally indicated at 2 for attachment to an inlet end 4 of the barrel 1, and an elongated tube 5 mounted in the other or discharge end 6 of the barrel 1. The barrel 1 is defined by an elongated, streamline body 8 with a venturi passage 10 extending therethrough in the bottom end thereof, and a large recess 12 in the top thereof. The recess 12 is normally closed by a top plate 13, which is connected to the body 8 by screws 14. A threaded insert 16 containing a restricted orifice 17 extends into the inlet end of the venturi passage 10. A cylindrical opening 19 in the bottom of the body 8 intersects the venturi passage 10 in the inlet end thereof for introducing regulated air into the passage. The opening 19 is intended to receive a flame arrester and air restrictor (not shown), which is held in the countersunk opening 19 by a split ring 20.

It is to be understood that the fuel source could be either propane or natural gas. In the preferred embodiment, propane is the main gas supply.

A propane/air mixture in the venturi passage 10 is ignited by means of a spark plug 22, which extends through a partition 23 between the venturi passage 10 and the recess 12. The spark plug may be movable in either a 90° or ° angle to the ignition chamber. The top end 25 of the spark plug 22 is connected to a piezoelectric arc crystal 26 by a wire and clip 27. The arc crystal is actuated by means of an off-the-shelf push button 29, for example an Cuttles Hammond start button, which is mounted in a recess 30 in one side wall of the body 8 by means of a nut 32.

The retention line for carrying fuel in the tube 5 is defined by a small diameter tube 34 in the recess 12. A coupler 35 is used to connect the tube 34 to an inlet passage 36 in a recess 28 in the inlet end 4 of the barrel 1. The coupler 35 contains a restrictive orifice (not shown) to control flow of propane to the retention line 34. A similar coupler 40 is used to act as a seal for the tube 34 to an outlet tube 41, which extends downwardly through the discharge end of the venturi passage, and through the tube 5 to a burner nozzle 43. The discharge end 44 of the tube 41 is located in the perforated discharge or outlet end 45 of the nozzle 43. The discharge is directed at a 90° angle to the bottom of the nozzle 43.

Figure 5:
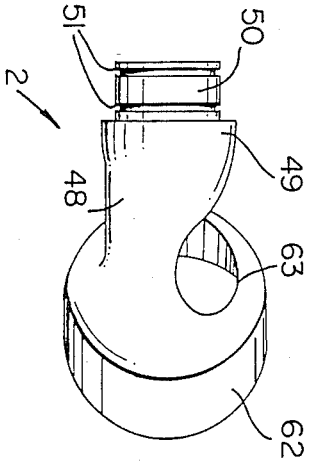
FIG. 5 is a plan view of a handle used in the torch of FIGS. 1 and 2.

The handle 2 (FIGS. 1, 2 and 5) is defined by a tubular body 48 with a solid top end 49. A cylindrical plug or projection 50 on such top end 49 is inserted into the socket defined by the cylindrical recess 38 to connect the handle 2 to the barrel 1. Annular grooves 51 (FIG. 5) are provided in the projections 50 for receiving O-rings 52 (FIGS. 1 and 2) to effect a seal between the barrel 1 and the handle 2. The handle 2 is held in the barrel 1 by set screws 53 (one shown), which extend radially inwardly through the inlet end 4 of the barrel 1 into contact with the projection 50. A passage 55 extends through the solid top end 49 of the body 48 and through the projection 50 to a concave recess 56 at the discharge end of the handle 2. The other or inlet end of the passage 55 is threaded for receiving the top end of a conventional needle valve 58, which is connected to the top end of a propane bottle 60 by a conventional coupling or connector 61. (Note—a quick disconnect would be substituted for 61 when natural gas is the fuel source.) The bottom end 62 of the body 48 defines a generally cylindrical cowl for receiving the top end of the propane bottle 60 when the needle valve 58, the bottle 60 and the coupler 61 are interconnected. An opening 63 (FIG. 5) is provided in one side of the body 48, permitting access to the needle valve 58.

In operation, when the needle valve 58 is opened, propane gas initially passes through the passage 55 and the recess 56 into the restricted orifice 17 and into the passage 36. The bulk of the propane passes through the tubes 34 and 41 to the burner nozzle 43. Some of the propane passes through the restricted orifice 17 and the venturi passage 10. Air is drawn into the passage 10 through the opening 19 and the flame arrester for mixing with the propane. By pressing the push button 29, the piezoelectric arc crystal 26 is actuated to cause arcing of the spark plug 22 which ignites the gas mixture in the venturi passage 10. The flame passes through the tube 5 to the burner nozzle 43 to ignite gas being discharged from the tube 41.

What is claimed is:

1. A portable hand torch for attachment to a gaseous fuel source comprising elongated barrel means; handle means on one end of said barrel means; inlet passage means in said handle means for feeding gaseous fuel from a fuel tank to said barrel means; coupler means in said handle means for connecting a fuel tank to said inlet passage means; elongated burner tube means on the other end of said barrel means for receiving gaseous fuel from the fuel tank; burner nozzle means on an outer free end of said burner tube means for burning gaseous fuel; retention gas line means in said barrel means for carrying gaseous fuel from the inlet passage means to said burner nozzle means; venturi passage means in said barrel means for carrying gaseous fuel from said inlet passage means to the inlet end of said burner tube means; restricted orifice means in said venturi passage means for limiting the quantity of gaseous fuel entering the venturi passage means from said inlet passage means; inlet opening means in said venturi passage means for introducing air into said venturi passage means for mixing with gaseous fuel entering said venturi passage means through said restricted orifice means; spark producing means in said venturi passage means for igniting the mixture of air and gaseous fuel in said venturi passage means, whereby, when gaseous fuel is fed into said inlet passage means under pressure, the gaseous fuel flows through the retention gas line means and said venturi passage means, and once ignition has been achieved in said venturi passage means flame passes through said burner tube means to ignite gaseous fuel from said retention gas line means, and thereafter burning is limited to the area of the burner nozzle means.

2. A torch according to claim 1, including plug means on one end of said handle means; and socket means in said barrel means for receiving said plug means to connect the handle means to the barrel means.

3. A torch according to claim 2, wherein said handle means includes cowl means on the other end thereof for receiving the top end of a gaseous fuel tank.

4. A torch according to claim 1, wherein said barrel means includes recess means containing and permitting access to said retention gas line means.

5. A torch according to claim 4, wherein said spark producing means includes a spark plug mounted in said recess means and extending into said venturi passage means; actuating means in said recess means for causing the spark plug to fire.

6. A torch according to claim 5, wherein said actuating means includes piezoelectric arc crystal means in said recess means connected to the spark plug; and push button means in said barrel means for external operation of said arc crystal means.

7. A torch according to claim 6, including removable cover means normally closing said recess means.

* * * * *